United States Patent [19]

Simpson

[11] 3,935,682

[45] Feb. 3, 1976

[54] CLEANING FASTENERS

[75] Inventor: Harold Graves Simpson, Oklahoma City, Okla.

[73] Assignee: Star Manufacturing Company, Oklahoma City, Okla.

[22] Filed: Feb. 25, 1974

[21] Appl. No.: 445,498

[52] U.S. Cl. ..... 52/105; 52/536

[51] Int. Cl.[2] ..... E04D 3/363

[58] Field of Search ..... 24/201 C; 52/536, 592, 52/105; 116/114 R

[56] References Cited

UNITED STATES PATENTS

| | | | |
|---|---|---|---|
| 2,613,421 | 10/1952 | Madsen | 24/201 C |
| 2,797,463 | 7/1957 | Dorman | 24/201 C |
| 2,810,944 | 10/1957 | Sander | 24/201 C |
| 3,038,205 | 6/1962 | Plummer | 24/201 C |
| 3,200,553 | 8/1965 | Frashour | 52/595 |
| 3,455,076 | 7/1969 | Clarvoe | 52/309 |
| 3,627,600 | 12/1971 | Peiter | 24/201 C |

*Primary Examiner*—John E. Murtagh

*Attorney, Agent, or Firm*—Hubbard, Thurman, Turner & Tucker

[57] ABSTRACT

A construction system is disclosed utilizing prefabricated panels which can be assembled in a contiguous, aligned relationship to form a construction section. In one form of the system, the individual panels may include a structural core with a flexible membrane covering, and include an edge portion adapted to engage the edge portion of the next adjacent panel to provide a substantially continuous seal between panels. The edge portions are sealable by fasteners which may be in the form of interlocking male and female members. The male and female member of the respective fasteners are proportioned so that when joined the male members of one fastener will wipe along the inside walls of the fastener to which it is being connected to clean dirt from these walls and push the dirt into one or more dirt cavities formed when the fasteners are joined.

10 Claims, 6 Drawing Figures

CLEANING FASTENERS

This invention relates to a construction system utilizing prefabricated panels adapted to form a roof, wall, flashing, accessory, tank, container, pool, pond liner, or other construction sections, and in one of its aspects to interlocking, self-cleaning fasteners for use in providing a substantially continuous seal between the panels.

The construction of roofs, walls and other elements by conventional methods is a laborious process usually requiring on-site fabrication and erection of a suitable support structure. In an attempt to improve on conventional construction methods, it has been suggested to utilize panels which are prefabricated at the factory and are secured together at the job site. Copending patent applications Ser. No. 336,370, entitled Roof Construction, and Ser. No. 336,364, entitled Construction System, both filed on Feb. 27, 1973, and assigned to the assignee of this invention, illustrate highly satisfactory apparatus and methods for providing such improvements.

In patent application Ser. No. 336,364, a composite panel is disclosed as having a structural core which may be conventional laminated foam, cellular honeycomb or concrete, as well as other construction materials. An exterior sheeting or membrane of weathertight material such as a plastic or light gauge metal is secured to the outer surface of the panel. The membrane is formed with a flap along one or several edges which is adapted to overlie a marginal protion of an adjacent panel. The membrane flap is adapted to sealingly engage the marginal portion of the next adjacent panel. In the preferred form of the invention disclosed in that application, the flap and marginal membrane portions are sealable by virtue of male and female interlocking fasteners carried on the respective membrane portions. The interlocking fastener structure may take various forms and may include an expandable section to accommodate field assembly.

In patent application Ser. No. 336,370, a prefabricated panel is disclosed which is ideally suited for roof construction. The panel utilizes a corrugated metal member as a structural core, and an exterior, weather resistant sheet material is pre-adhered to the panel exterior. The sheet material is formed with a flap along one or several edges which is adapted to overlie a marginal portion of an adjacent panel. A seal is effected between overlapping membrane members by vulcanization or by virtue of interlocking fasteners carried on the flap and the marginal portions of the next adjacent panel.

In any such system as described with respect to the referenced co-pending patent applications, the fasteners employed for connection to the panels in the field must be easily and quickly operated, and must provide an effective continuous seal such as against weather. In co-pending patent application entitled "Construction System Employing Prefabricated Panels", an improved fastener or zipper is disclosed which provides such and also provides a distinctive visual indication when the fastener is not fully closed. However, in this fastener and other prior fasteners of different configurations, it is not uncommon for dirt to get into and along the inside of the coupling member of the fastener, particularly during field use. When such occurs, because of the relatively close fit of the coupling members of the fasteners dirt is pushed and packed inside the fastener during joining of two fasteners until, in some cases, it is difficult to fully close the fasteners and a leak may occur between them.

In the construction system of the present invention, which is of the same general type as disclosed in the aforementioned co-pending patent applications, this problem is effectively eliminated or substantially reduced by providing a plurality of construction panels each of which includes a core member, and an exterior sheeting or membrane member formed with a novel fastener disposed along each adjacent edge of the membrane member of adjacent panels for interlocking engagement therebetween. Each such fastener includes means for wiping along the inside walls of another fastener to be connected therewith to wipe away dirt accumulated thereon, and at least one dirt cavity is provided in the fastener for receiving the dirt as it is pushed from the inside walls of the fastener. The respective fasteners that are coupled together include male and female interlocking members and the dirt cavity is formed by making the female portion deeper than the extent of penetration of the male member. As the fasteners are joined, the male member of each fastener wipes down across the inside surface of the mating female members of the other fastener and dislodges dirt or dust on these surfaces to allow a good seal between the fasteners. If this dirt were not removed by this wiping process, it would form a permeable barrier and act as a channel to allow the water, air, or other fluid to penetrate the fasteners by flowing through the channel.

In the embodiment of this invention illustrated herein, the fastener is an elongated zipper of flexible material that includes a body portion having male and female coupling means, such as projecting ribs and intermediate grooves for interlocking engagement with an identical zipper on an adjacent panel. The zippers include a connecting web extending from the zipper body which may be bonded to the edge of each membrane member so that the zippers along two opposite edges of the membrane member face inwardly towards the panel, and the zippers along the other two opposite edges of the membrane member extend outwardly from the panel. The zippers can be disposed along their respective membrane member edges so that they slightly extend beyond these edges an amount so that when adjacent panels are abutting each other adjacent zippers are overlapped for proper engagement. Also, if desired, the membrane members can be provided with opposite flap and marginal portions along their edges as described in patent application Ser. No. 336,364, with the fastener of this invention disposed along each of these portions, or the expansion/construction feature illustrated in that application may be utilized if the fasteners are not overlapped as described.

In designing fasteners of the type utilized in the present invention a difficult problem is to provide adequate sealing between the fasteners. This is particularly true where inclusion of some dirt which is not wiped away occurs, or a manufacturing defect occurs in a section of one of the fasteners. In order to ensure proper sealing, particularly in the instances noted, it is preferred that several intensive line contacts (analogous to a knife edge) be provided between the surface of the contacting fasteners instead of extensive contact between flat surfaces.

In the process of producing the fasteners of the present invention, it is more difficult to consistently get two large flat surfaces that mate continuously than it is to have one flat surface and one knife-like edge surface mate continuously. This is especially true since the fasteners of the present invention are generally made of a somewhat flexible material than can deform slightly so that any given amount of pressure will be much more intense (force/square unit) if distributed across the knife edge rather than if distributed across two more massive surfaces. Thus, by creating a number of relatively intense contact points, water can be effectively prevented from passing these points.

Each of the intense contact points should be complete, continuous and of enough intensity to prevent the pressure of the water from forcing the surface of adjoining fasteners apart and from passing between those two surfaces. Also, by using multiple points of intense contact, even if dirt is not wiped from one area, or a manufacturing defect prevents adequate sealing in one area, other areas of contact will provide sealing.

An important feature of the present invention is that the fasteners employed can be readily designed to include these areas of intense contact.

Thus, by use of the novel zipper design disclosed and claimed herein, a construction system is provided which can be erected and installed efficiently and economically with a good chance that the integrity of the seal provided by the system will be greatly increased because dirt accumulated on the fastener elements will not normally impede proper connection of the fasteners.

DETAILED DESCRIPTION OF THE DRAWINGS

In the drawings, wherein like reference numerals are used throughout to designate like parts, and wherein a preferred embodiment of this invention is illustrated;

Figure 1:
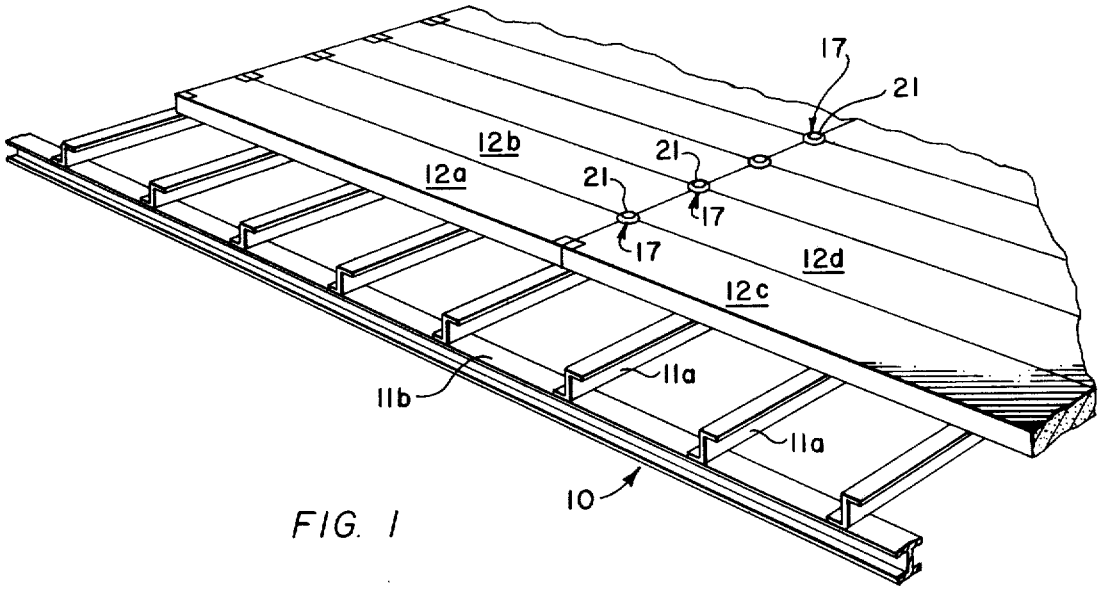
FIG. 1 is a perspective view showing a number of the panels of the present invention assembled to form a typical construction section, such as a roof.

Referring now to the drawings, FIG. 1 shows a construction assembly generally designated by the numeral 10 supported on an underlying series of parallel Z-shaped purlins 11*a* supported on a plurality of parallel beams or rafters 11*b*. Beams 11*b* are, in turn, supported on columns or bearing walls (not shown) as known in the art. For purposes of illustration, construction assembly 10 is shown in a horizontal position as representative of a typical roof structure. However, it should be noted that the assembly could as well be an exterior building wall.

Figure 2:
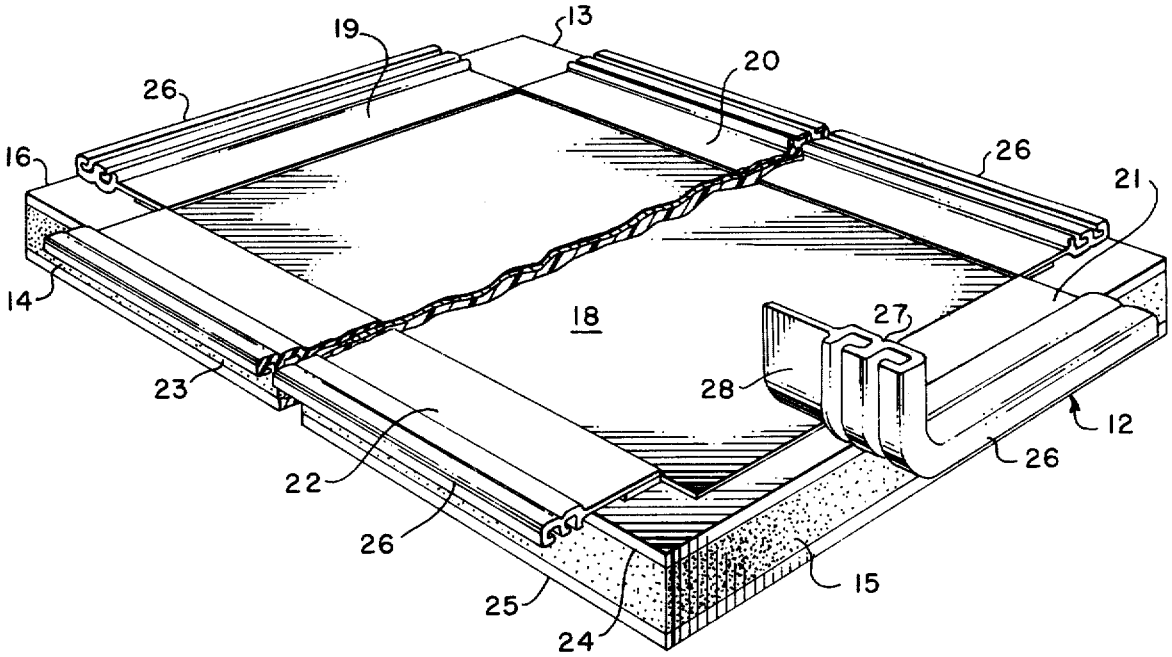
FIG. 2 is an enlarged perspective view of a single panel.

Construction assembly 10 includes a plurality of individual structural panels generally designated by the numeral 12 with the appended letters *a*, *b*, *c* and *d* used to denote separate panels of similar construction. The panels may, for example, be three feet wide by 20 to 30 feet long. In FIGS. 1 and 2, panel 12 is shown as being rectangular having opposite side edges 13 and 14 and opposite end edges 15 and 16. A number of similar panels 12 are contiguously aligned in a side-by-side and end-to-end arrangement to form assembly 10 with the individual panels abutting at common corner junctures 17. Panels 12 are covered with outer membrane sheet 18 of a weather resistant flexible material preadhered to the exterior surface, and membrane 18 includes edge portions 19, 20, 21 and 22 adapted to overlap with similar such edge portions of the next adjacent panel in a sealing relationship. The corner junction 17 of several panels may be sealed by a corner sealing structure 21, such as the corner sealing structure illustrated in copending patent application Ser. No. 336,364, referenced above.

Referring to FIG. 2, the individual panel 12 is formed having a structural core member 23 of a suitable material having good compressive, insulative, flexible and shear strength characteristics. For example, core 23 could be a urethane foam or a polystyrene. The upper surface of core member 23 is covered by sheathing member 24 and the lower or interior side of core member 23 is covered by sheathing member 25. Sheathing members 24 and 25 are typically a plastic or metal material suitably bonded or laminated to the opposite sides of core 23 which serve to give additional strength to the structure. Upper sheathing 23 also serves to provide a relatively hard, smooth underlay or surface beneath flexible membrane 18. Sheathing 25 may be provided with an appropriate decorative treatment when exposed within the building interior.

As noted, upper sheathing 23 is covered with membrane sheet 18 in the form of a weather resistant material to protect and seal the roof system 10. Membrane sheet 18 is substantially coextensive with the upper surface of the plank along its edges, except that its edge portions 19, 20, 21 and 22, including fasteners 26 are described in detail here, extend slightly beyond the edges 13, 14, 15 and 16 for overlapping relationship with similar such apparatus on an adjacent panel. For purposes of showing detail, fasteners 26 in FIG. 2 are slightly exaggerated in size in comparison with panel 12 since they are generally in the order of about ½ inch wide and ¼ inch high. Membrane 18 is preferably a natural or synthetic rubber, or plastic, bonded or adhesively joined to the surface of upper sheathing member 23. Membrane 18, for example, may be of a material known under the trade name "Flex Seal" of B. F. Goodrich Tire & Rubber Co., which is a filled Hypolon sheet. Other material such as a flexible, light gauge aluminum or galvanized sheeting may be used as a material for the membrane.

Figure 3:
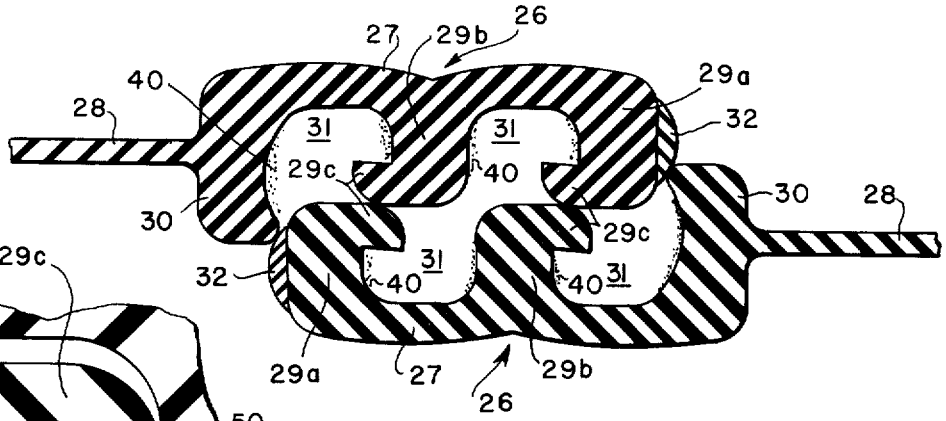
FIG. 3 is a sectional view of two fasteners of this invention just prior to joining.
Figure 4B:
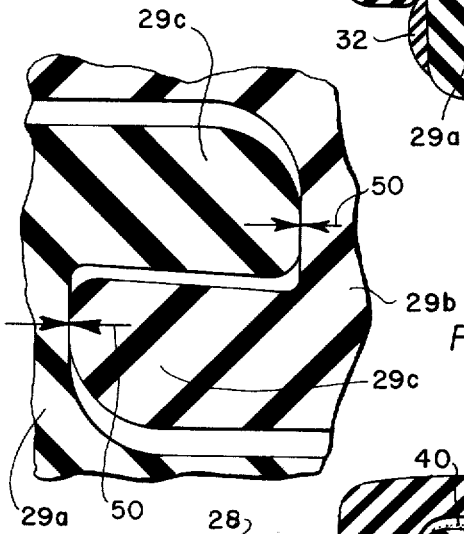
FIG. 4B is an enlarged view of a portion of FIG. 4A.
Figure 4A:
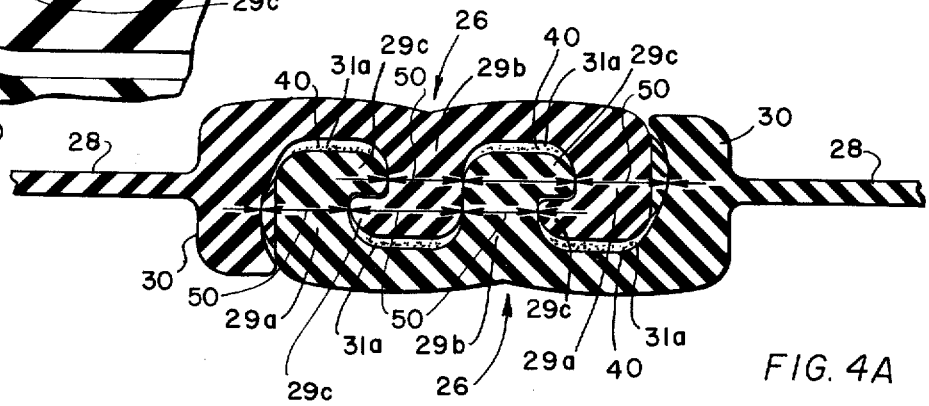
FIG. 4A is a sectional view similar to FIG. 3, but with the fasteners joined.
Figure 5:
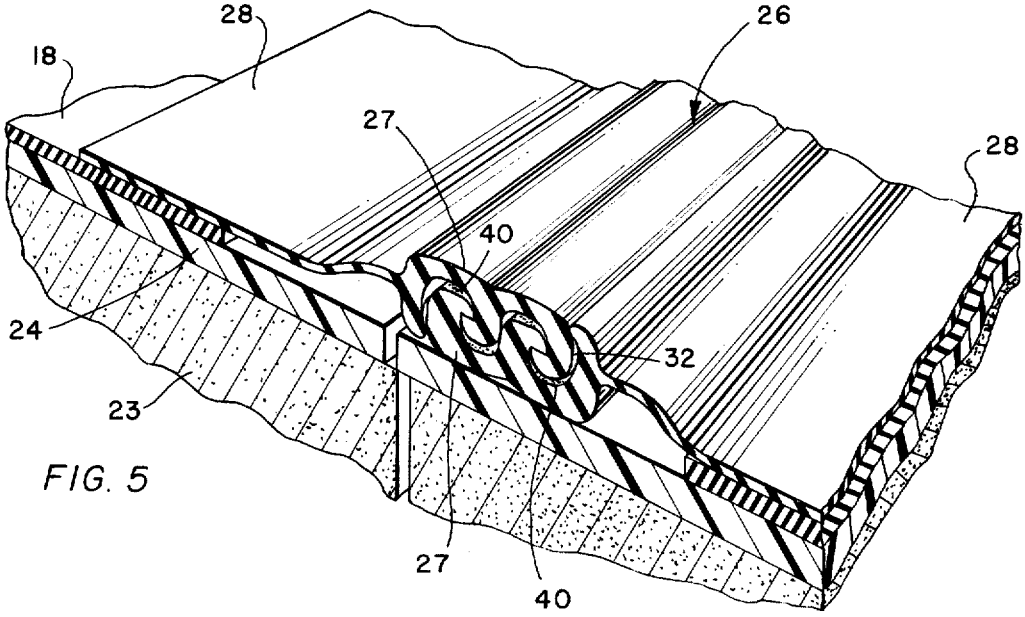
FIG. 5 is a perspective view showing adjoining fasteners of this invention connected to form a seal between adjacent panels.

Fasteners 26, which are shown in detail in FIGS. 3 – 5, are shown along either the longitudinal edges 20 and 22, or transverse edges 19 and 21 of membrane member 18. In either case, fasteners 26 may be identical except that along edges 21 and 22 they face outwardly from panel 12, and along edges 19 and 20, they face inwardly towards panel 12. Also, along edges 19 and 20, fasteners 26 may extend only a small distance beyond edges 14 and 16 of panel 12, and fasteners 26 along edges 21 and 22 may extend beyond edges 13 and 15 of panel 12 a lesser amount as shown in FIGS. 7 and 8, so long as the adjacent fasteners overlap each other so that they can be properly engaged when the adjacent panels carrying them are in substantial abutment.

Fasteners 26 include male and female coupling means, such as parallel, longitudinal ribs with grooves between them, as described below, and the ribs and grooves of fasteners 26 are adapted to interlock when force is applied, forcing the ribs into the grooves. The coacting sections are thus capable of being interlocked in zipper fashion to form a tight mechanical seal. Thus, fasteners 26 can easily be engaged by workmen as the panels are assembled to form a watertight seal. In some instances, an adhesive or vulcanizing agent can be applied between the coacting grooves and ribs at the time of securing the overlying membranes together to further ensure against penetration of moisture and seal the interior panel structure.

Various configurations of the male and female coupling means are suitable for the fastener arrangement. However a suitable configuration of fasteners 26 is shown as described with respect to FIGS. 3 – 5. In FIG. 3, two adjacent fasteners 26 are illustrated just prior to joining and in FIG. 4 they are shown in cross section as they would look when joined.

Referring now to FIGS. 3 – 5, a preferred form of fastener 26 is illustrated as an integral structure which may be separately manufactured and bonded to membrane member 18 during construction of panel 12. Fastener 26 includes an elongated body portion 27 and an elongated, flat web portion 28 extending from body portion 27 and adapted to be bonded to and along an edge of membrane member 18, or if desired, directly to the panel if made of suitable material. Fastener 26 may be made of the same type of flexible material as membrane member 18, in elongated strips, and the strips may be cut to the appropriate length for mounting on the membrane member to form each of the respective edges of member 18. Body portion 27 of fastener 26 includes parallel ribs 29 and, in the embodiment illustrated, two such ribs are provided, with a kick flap 30, and two grooves 31 formed by and between ribs 29 and kick flap 30. As illustrated, the outer rib is designated **29*a*, and the inner rib 29*b*. Ribs 29*a* and 29*b* include inwardly projecting tooth portions 29*c* for aiding in locking two such fasteners together when engaged. Body portion 27 therefore provides coupling means for interlocking engagement with similar coupling means on the adjacent fastener 26 on the adjacent panel 12.**

As shown in FIGS. 3 and 4, ribs **29*a* and 29*b* are of such length with respect to grooves 31 so that when the adjacent fasteners are engaged as in FIG. 4, a small dirt cavity 31*a* is formed in groove 31 between the end of the rib projecting into the groove and the inner end wall of the grooves. Otherwise, the mating rib and groove elements are designed to have an interference or close fit to seal between them, preferably along the areas indicated by the arrows 50 in FIG. 4A to establish points of intense contact as previously described. FIG. 4B shows this arrangement in more detail. With the construction, as illustrated, if dirt (shown generally as 40) accumulates on the inside walls of a fastener 26, as it is joined to another fastener 26, the ribs 29*a* and 29*b*, and particularly projections 29*c* of each fastener, and the outside surface of rib 29*a*, will wipe along the adjacent inside wall of the other fastener to force the dirt down into cavities 31*a*, and since the cavities are present, permit the fasteners to be engaged with little or no interference. The size and depth of the dirt cavities formed can vary as long as the structural integrity and sealing effectiveness of the fastener is not impaired. For this purpose, the thickness of the hook-shaped extension 29*c* in the direction in which the rib member extends is substantially less than the depth of grooves 31 to permit cavity 31*a*** to be formed.

If desired, a color stripe, such as provided by a strip 32 of material having a color different from the rest of fastener 26, may be provided along the outer edges of each of fasteners 26. In this case, the outer edge of strip 32 of one fastener will wipe along the adjacent inside surface of the grooves 31 of the other fastener into which it fits.

Thus, a construction system is provided by the present invention which provides for ready connection and sealing of adjacent panels of the system even where one or more of the coacting fasteners may have dirt accumulated inside of it prior to installation. Of course, even with the present invention, the amount of dirt inside the fastener that can be wiped into the dirt cavities and permit proper fastening cannot be excessive, however, by use of the present invention, many field installations are made possible where they would otherwise not be possible.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A construction system comprising:

at least first and second panels each having at least first and second edges and being of a geometric shape adapted for assembly in a contiguous, aligned relationship with a first edge of one panel in abutting relationship with the second edge of the adjacent panel;

each of said panels being provided with a sheet of membrane material adhering to one surface of the panel; and coacting fasteners carried on each sheet along adjacent edges of said panels, said fasteners adapted to engage to provide a substantially continuous exterior seal between adjacent panels, each of said coacting fastener apparatus including a fastener body having coupling means arranged to include a dirt cavity when two such fastener apparatus are coupled together, so that when said apparatus are engaged and coupled together each coupling means wipes along the other coupling means to push dirt thereon into said dirt cavity and each of said fasteners further including an indicator means for providing a distinctive visual indication adjacent fasteners are not at least substantially fully engaged.

2. The construction system of claim 1 wherein said coupling means are male and female members.

3. The construction system of claim 1 wherein said male members include a plurality of ribs defining a plurality of grooves between them which form the female members for receipt of the ribs of another fastener to be coupled therewith.

4. The fastener of claim 3 wherein at least one of said ribs includes a hook-shaped extension for interlocking engagement with a similar such extension on a fastener to be coupled therewith.

5. A construction panel comprising:

a structural core member having a geometric shape adapted to be cooperatively arranged in abutting relationship with other similar members to form a construction section;

a membrane sheet substantially covering said core member and having its edge extending along the corresponding edge of the core member;

a fastener adapted to be disposed along an edge of said membrane sheet and adapted to interlock with another fastener disposed along the adjacent edge of an adjacent panel in the construction section to provide a seal between the adjoining panels, said fastener including a fastener body having at least one male coupling and at least one female coupling member which forms a receptacle for receipt of the male coupling member of another fastener, the depth of such female coupling member being such that a cavity for collection of dirt is provided between the wall of said fastener body and the male coupling members received in said female coupling member, said fastener further including means for providing a distinctive visual indication when the fastener is not at least substantially fully fastened with another such apparatus; and a web portion extending from said body to provide for bonding of said fastener to said membrane sheet.

6. The structural panel of claim 5 wherein at least one of said male coupling members includes a hook-shaped extension for interlocking engagement with a similar such extension on another such fastener.

7. A fastener adapted to be disposed along an edge of a panel in a construction system including a plurality of such panels arranged end to end, and adapted to interlock with a fastener disposed along the adjacent edge of an adjacent panel in the construction system to provide a seal between the adjoining panels, said fastener comprising, in combination:

a fastener body including a plurality of rib members defining a plurality of grooves between them which form receptacles for receipt of rib members of another fastener including such rib members, the depth of such grooves being such that a cavity for collection of dirt is provided between the wall of said fastener body and rib members received in said grooves, said fastener body further including means for providing a distinctive indication when said fastener is not at least substantially fully fastened with a similar such fastener; and a web portion extending from said body to provide for bonding of said fastener to a structural panel.

8. The fastener of claim 7 wherein at least one of said rib members includes a hook-shaped extension adapted to interlock with a similar such extension on another such fastener.

9. The fastener of claim 8 wherein the thickness of said hook-shaped extension in the direction in which the rib member including such extension extends is substantially less than the depth in the same direction of the groove formed by said rib member.

10. The fastener of claim 8 wherein three rib members are provided to form two grooves, and said hook-shaped extensions are provided on two of said rib members, and wherein the thickness of said hook-shaped extensions in the direction in which the rib members extend is substantially less than the depth of said grooves in the same direction.

* * * * *